United States Patent [19]

Torii et al.

[11] 4,120,764

[45] Oct. 17, 1978

[54] PROCESS FOR PRODUCING A TETRAALKYLTHIURAM DISULFIDE

[75] Inventors: Sigeru Torii; Hideo Tanaka; Kiyoshi Mishima, all of Okayama, Japan

[73] Assignee: Ouchi Shinko Kagaku Kogyo Kabushiki Kaisha, Tokyo, Japan

[21] Appl. No.: 869,409

[22] Filed: Jan. 16, 1978

[30] Foreign Application Priority Data

Jan. 20, 1977 [JP] Japan ..... 52-4375
Feb. 23, 1977 [JP] Japan ..... 52-18073

[51] Int. Cl.[2] ..... C25B 3/02; C07C 155/10

[52] U.S. Cl. ..... 204/78; 204/59 R; 204/72; 260/569

[58] Field of Search ..... 204/72, 78, 59 R; 260/567

[56] References Cited

U.S. PATENT DOCUMENTS

| | | | |
|---|---|---|---|
| 3,193,580 | 7/1965 | Werres et al. | 260/567 |
| 3,255,251 | 6/1966 | Budd | 260/567 |
| 3,472,747 | 10/1969 | Smith | 204/72 |

FOREIGN PATENT DOCUMENTS

| | | | |
|---|---|---|---|
| 9,269/63 | 6/1963 | Japan | 260/567 |

*Primary Examiner*—F.C. Edmundson
*Attorney, Agent, or Firm*—Ladas, Parry, Von Gehr, Goldsmith & Deschamps

[57] ABSTRACT

A process for producing a tetraalkylthiuram disulfide which comprises electrolytically oxidizing a dialkylammonium dialkyldithiocarbamate having the formula

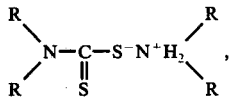

wherein each R represents an alkyl group having from 1 to 4 carbon atoms, in the presence or absence of a supporting electrolyte to produce a tetraalkylthiuram disulfide, the electrolytic oxidation being carried out in one or more solvents which dissolve at least one of the starting dialkylammonium dialkyldithiocarbamate and the resulting tetraalkylthiuram disulfide.

8 Claims, No Drawings

PROCESS FOR PRODUCING A TETRAALKYLTHIURAM DISULFIDE

BACKGROUND OF THE INVENTION

The present invention relates to a process for producing a tetraalkylthiuram disulfide. More specifically, it is concerned with a process for producing a tetraalkylthiuram disulfide which comprises directly obtaining the tetraalkylthiuram disulfide by electrolyzing a secondary amine having an alkyl group containing from 1 to 4 carbon atoms and carbon disulfide in an electrolytic solvent consisting of any suitable solvent in the presence or absence of any suitable supporting electrolyte.

By way of example, one conventional industrial process for producing a tetraalkylthiuram disulfide which is used as a vulcanization-accelerator or vulcanizing agent for rubbers comprises reacting a dialkylamine with carbon disulfide at a low temperature in the presence of an aqueous solution of sodium hydroxide to form an aqueous solution of sodium dialkyldithiocarbamate, refining the aqueous solution, adding by dropping sulfuric acid and hydrogen peroxide as an oxidizing agent to the resulting aqueous solution to neutralize the same, oxidizing the dialkyldithiocarbamate acid resulting from the neutralization simultaneously with the neutralization, filtering the precipitate of the resulting product, tetraalkylthiuram disulfide, washing the same with water, dehydrating and drying the same, and crushing the same, if necessary.

Furthermore, in the oxidative dimerization of sodium dialkyldithiocarbamate, in addition to the above mentioned hydrogen peroxide, use has been made, as an oxidizing agent, of nitrogen dioxide ($NO_2$), chlorine ($Cl_2$), bromine ($Br_2$), iodine ($I_2$), ozone ($O_3$), oxygen ($O_2$), sodium nitrite ($NaNO_2$), sodium hypochlorite (NaOCl), sulfur monochloride ($S_2Cl_2$), sulfur dichloride ($SCl_2$), potassium perbromate ($KBrO_3$), selenic acid ($H_2SeO_3$), and ammonium persulfate [$(NH_4)_2S_2O_8$]. All of the processes using these oxidizing agents require a stoichiometric quantity of an oxidizing agent and a neutralizing agent, and the use of these chemicals requires special handling caution with regard to the reaction apparatus, the incidental apparatus, and process control.

In addition, in order to reduce or eliminate the use of chemical reagents such as a neutralizing agent, a process for oxidizing directly a dialkylamine and carbon disulfide in a solvent of water to convert them into a dialkylthiuram disulfide has also been devised. In this case, hydrogen peroxide, potassium perbromate, oxygen-cobalt phthalocyanine disulfonate, oxygen-iron (or cobalt or nickel) phthalocyanine carboxylate and the like are used as an oxidizing agent.

All of these conventional processes are not fully satisfactory in that not only is an oxidizing agent or oxidizing catalyst required, but the production processes are also significantly complex and, as a result, side effects occurring during the oxidation reaction cannot be avoided. For this reason, it is necessary to simplify the complex production process causing many problems with regard to the control of production and, at the same time, to remove the pollution due to waste water caused by by-products. In this connection, there is also an urgent demand for the reduction of the large sum of equipment investment required for the treatment of waste water and the treatment cost.

SUMMARY OF THE INVENTION

In view of the above described problems encountered in the prior art, we have carried out studies directed toward their solution. As a result, we have found that when an electrolytic solution consisting of any suitable solvent is provided, and a dialkylammonium dialkyldithiocarbamate which is conveniently available by mixing or agitating any dialkyl amine and carbon disulfide in the solvent and has the formula:

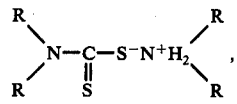

wherein each R represents an alkyl group having from 1 to 4 carbon atoms, is electrolytically oxidized, if necessary, in the presence of a suitable quantity of a supporting electrolyte without the use of any of special oxidizing agents, acids or alkalis, the desired tetraalkylthiuram disulfide is easily formed with the progress of the electrolytic reaction, and the product is simply obtained by condensing the electrolytic solution at the end of the electrolytic reaction or, in the case where the electrolytic solution comprises water and a hydrophobic solvent, separating the hydrophobic solvent from the solution and condensing the resulting solution. This invention is based on these findings.

Therefore, in its broadest sense, the present invention provides a process for producing a tetraalkylthiuram disulfide comprising electrolytically oxidizing a dialkylammonium dialkyldithiocarbamate having the formula:

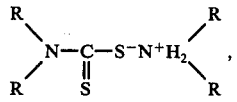

wherein each R represents an alkyl group having from 1 to 4 carbon atoms, in the presence or absence of a supporting electrolyte to produce a tetraalkylthiuram disulfide, the electrolytic oxidation being carried out in one or more solvents which dissolve at least one of the starting dialkylammonium dialkyldithiocarbamate and the resulting tetraalkylthiuram disulfide.

According to one embodiment (embodiment A) of the present invention, the above mentioned solvent is a mixture of water and a hydrophobic solvent. In this case, the dialkylammonium dialkyldithiocarbamate is electrolyzed in an aqueous layer, and the resulting tetraalkylthiuram disulfide is efficiently transferred into the hydrophobic solvent, being continuously and automatically extracted thereinto. As a result, the reaction automatically terminates, and the desired product can be obtained by separating the hydrophobic solvent portion from the reaction mixture at the end of the reaction and merely condensing the solvent.

According to another embodiment (embodiment B) of the present invention, the solvent comprises an organic solvent (only organic solvent or a homogeneous mixture thereof with water). In this case, the objective product can be obtained by merely condensing the electrolytic solution at the end of the electrolytic oxidation.

Thus, the present invention is a process for producing a tetraalkylthiuram disulfide by carrying out direct electrolytic oxidative coupling of a dialkyl amine and carbon disulfide according to the following reaction:

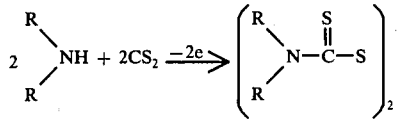

wherein each R represents an alkyl group having from 1 to 4 carbon atoms, while passing an electric current through the reaction system for a period of time required to terminate the reaction at a terminal voltage suitable for the formation of the tetraalkylthiuram disulfide at approximately room temperature merely by maintaining a terminal voltage at a constant value without any special control of potential by selecting an appropriate combination of a solvent, a supporting electrolyte, and electrodes.

DETAILED DESCRIPTION

Secondary amine

The starting material of the present invention is a dialkylammonium dialkyldithiocarbamate. This material is produced by mixing the corresponding secondary amine and carbon disulfide in a suitable solvent (ordinarily at least a portion of the solvent constituting an oxidative electrolytic solution).

Such a secondary amine is represented by the formula

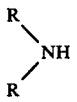

wherein each R represents an alkyl group having from 1 to 4 carbon atoms. Examples of such a secondary amine are dimethylamine, diethylamine, dipropylamine, diisopropylamine, dibutylamine and ditertiary butylamine.

Solvent

A solvent constituting an electrolytic solution is a solvent which will dissolve at least one of the starting dialkylammonium dialkyldithiocarbamate and the product, tetraalkylthiuram disulfide.

According to the embodiment A of the present invention, the solvent is a heterogeneous mixture of water and a hydrophobic solvent. The water is a solvent which produces the starting dialkylammonium dialkyldithiocarbamate from the corresponding secondary amine and carbon disulfide ($CS_2$) and dissolves it, and this solvent may also constitute an electrolytic solvent. On the other hand, the hydrophobic solvent is a solvent which has the ability to dissolve the product, tetraalkylthiuram disulfide. That is, it is important that the hydrophobic solvent have the effect of extracting the product continuously and form a solvent layer which is entirely insoluble in water and is clearly distinguishable from an aqueous layer.

One of the solvents suitable for such a purpose is a solvent having a lower density than water. Examples of such a solvent are various saturated or unsaturated hydrocarbons, lower aliphatic acid esters and ethers, and mixtures thereof. These solvents form a layer on the aqueous layer. Also, as a solvent having a higher density than water, there may be mentioned dichloromethane, chloroform, dichloroethane, trichloroethane, methyl (or ethyl) trichloroacetate, and carbon disulfide. These solvents are positioned under a water layer, but all of these solvents are good extraction solvents and can be used for the above mentioned purpose.

During the electrolysis, two groups of solvent are intermixed with each other by agitation and may be partially emulsified in the presence of a dialkylamine, carbon disulfide, dialkylammonium dialkyldithiocarbamate and the product. However, this is never a disadvantageous condition for the electrolytic oxidation. Various hydrophobic solvents capable of dissolving the product have the effect of washing the surface of an electrode by contacting the electrode when agitation is occasionally carried out during electrolysis, whereby the desired product can be more easily and effectively obtained.

The solvent used in the other embodiment B of the present invention comprises an organic solvent only (in this case a mixture of organic solvents is included) or a homogeneous mixture of water and a hydrophilic organic solvent.

Examples of such an organic solvent are various saturated or unsaturated hydrocarbons, lower aliphatic esters, lower alkyl ethers, lower alcohols, lower amines, dichloromethane, chloroform, dichloroethane, trichloroethane, methyl (or ethyl) trichloroacetate and aprotic polar solvents such as N,N-di-lower alkyl formamide or acetamide, for example, N,N-dimethylformamide, N,N-dimethylacetamide, di-lower alkyl sulfoxide, for example, dimethyl sulfoxide, lower aliphatic acid nitriles, for example, acetonitrile (the term "lower" representing from about 1 to 3 carbon atoms).

These solvents may be used singly or in mixtures thereof for the above described purpose. Preferably, acetonitrile, carbon disulfide, N,N-dimethylformamide, N-methylformamide and N,N-dimethylacetamide are used singly or in combination. Further, a solvent mixture of one or more of the above described solvents and water may be used.

Electrolytic oxidation

Representative examples of the supporting electrolyte for passing an electric current smoothly through an electrolytic cell which may be used in the present invention are lithium perchlorate, magnesium perchlorate, quaternary ammonium perchlorate, quaternary alkylammonium tetrafluoroborates, quaternary ammonium tatrafluoroborates, quaternary alkylammonium halide, quaternary ammonium halide, alkali metal halides, quaternary alkylammonium nitrates and quaternary alkylammonium para-toluene sulfonates (wherein an alkyl group signifies methyl, ethyl and propyl groups; an alkali metal signifies lithium, sodium and potassium; and a halogen signifies chlorine, bromine and iodine). With regard to the role of the supporting electrolyte in the electrolytic oxidation and its example, reference is made to C. K. Mann: Electroanal. Chem. 16 157 (1969).

When electrolysis is carried out in a two liquid phase system, the addition of a small or catalytic quantity of an alkali metal hydroxide (the alkali metal being lithium sodium, potassium, etc.) to the electrolytic solution can result in an advantageous promotion of the electrolysis.

The electrodes used in the present invention may be commercially available electrodes for electrolysis which are made of platinum or carbon or electrodes fabricated from carbon, titanium oxide or other electrically conductive metal oxide materials, and those electrodes the surfaces of which have been subjected to any pretreatment.

It is to be understood that the solvent, supporting electrolyte and electrodes which may be used in the present invention are not limited to the above described illustrative examples.

The electrolytic reaction with which the present invention is concerned is carried out by adding a dialkylamine and carbon disulfide in a quantity of 0.1 to 10 times, preferably 0.5 to 2.0 times, that of the dialkylamine on the basis of one mole of the dialkyl amine to a selected solvent (preferably, to a water layer if the solvent consists of a two layer system of water and a solvent); adding 0.01 to 0.5 mole/liter of a supporting electrolyte to the electrolytic solution, if necessary; immersing platinum or carbon electrodes in a water layer to a sufficient depth; and electrolyzing the electrolytic solution while it is agitated.

However, when carbon disulfide is used as an extraction solvent, i.e., a hydrophobic solvent to be combined with water, if electrolysis is carried out for a two liquid layer system consisting of water containing an appropriate supporting electrolyte and carbon disulfide, a tetraalkylthiuram disulfide can be electrolytically synthesized in a continuous manner by replenishing the dialkyl amine and carbon disulfide consumed. The product transfers into an underlying carbon disulfide layer. Accordingly, the product can be conveniently obtained by removing the carbon disulfide layer in which an appropriate concentration of the product is contained and distilling off the solvent from the layer.

The reaction conditions under which the electrolytic oxidation is carried out depend on the shape of the electrolytic cell used and the type of the amine used. In the electrolysis according to the present invention, the objective product can be obtained by a conventionally used regulation procedure for electric current density and voltage. In order to make an electrolytic apparatus and its operation more simple and convenient, it is preferable that electrolysis be carried out at a terminal voltage maintained at a constant value. If this is done, the advantage that only the desired material can be conveniently and efficiently obtained is attained.

That is, when the electrolytic solution comprises a mixture of water and a hydrophobic solvent (embodiment A), electrolysis is carried out by merely maintaining the terminal voltage at a constant value of 1.0 to 10V, preferably 1.5 to 3V. Ordinarily, when electrolysis is carried out by maintaining the terminal voltage at a constant value, the electrode potential may vary somewhat. In practice, when calculated quantities of a dialkylamine and carbon disulfide are added to a homogeneous solvent such as acetonitrile or dimethylformamide, and a suitable quantity of the supporting electrolyte is further added to the resulting mixture to electrolyze the resultant electrolytic solution, if the electrolysis is carried out at a terminal voltage adjusted to a slightly higher level than the preferred level, by-products are mixed into the product. Particularly, when a carbon electrode on which a vigorous adsorption takes place in used, by-products are formed in a larger quantity under such an electrolytic condition.

However, because the product rapidly transfers into an extraction solvent layer, and the surfaces of the electrodes are effectively washed with an extraction solvent due to their contact from time to time with the electrodes in the electrolytic process of the present invention, which is carried out in a two liquid layer system, side reactions due to a little variation in electrode potential are avoided, and, as a result, a preferable terminal voltage can be selected over a wide range.

In case of an electrolytic solution comprising a homogeneous organic solvent (including an organic solvent containing water in a homogeneous mixture) (embodiment B), when electrolysis is carried out by merely maintaining the terminal voltage at a constant value, the preferable terminal voltage is set at a terminal voltage required to pass an electric current of 1 to 500 mA/cm$^2$, preferably 10 to 30 mA/cm$^2$, at the initial stage of reaction. The necessary terminal voltage may vary depending upon the type and shape of the electrodes used, the shape of the reaction vessel, and the manner of agitation, although it is ordinarily in the range of 2 to 20V. In this case, the electric current gradually decreases as the reaction proceeds, and the electrode potential varies in a range of 0.7 to 1.2V vs SCE between the initial stage and the final stage during the electrolysis.

The reaction temperature is generally in the range of 5° to 40° C., preferably 10° to 30° C.

The electrolytic oxidation is ordinarily carried out until a quantity of electricity of 2.0 to 2.5 F (Faraday)/mole (based on the thiuram disulfide) has passed.

After the electrolysis has been stopped, the electrolytic solution is divided into a water layer and a hydrophobic solvent layer in the embodiment A. The hydrophobic solvent layer, afaer being washed with water and dehydrated as required, is distilled to remove the solvent and volatile components having a lower boiling point. Thus, a tetraalkylthiuram disulfide is obtained in a yield of 98 to 100%. When the second embodiment (B), i.e., an electrolytic solution comprising a homogeneous aqueous or non-aqueous organic solvent is used, the reaction mixture is distilled to remove the solvent and volatile components and, if necessary, is dissolved in a suitable solvent, and the resulting solution is washed with water and dehydrated. Thereafter, when the solvent is distilled off, a tetraalkylthiuram disulfide is obtained in a yield of 98 to 100%.

The production process of the present invention may be carried out in either a batchwise manner or a continuous manner, particularly when the first embodiment A, i.e., a two layer system electrolytic bath comprising water and a hydrophobic solvent is used. The hydrophobic solvent and excessive amine or carbon disulfide are recovered as a distillate when the distilling off of the solvent is carried out, and the water layer containing the supporting electrolyte may be recycled as it is for further electrolytic reaction. The continuous system can exhibit the advantage that a continuous operation for an extremely long period of time is possible to a great extent because a dialkylamine and carbon disulfide maintained at a predetermined mole ratio can be occasionally added while continuously separating the product from the hydrophobic solvent layer.

The prior production process is inevitably accompanied by side reactions because it is a pure chemical reaction. Accordingly, the yield of the tetraalkylthiuram disulfide is in the range of 90 to 96%. On the contrary, according to the production process of the present invention, sodium hydroxide and an oxidizing agent are not required, and since the added supporting electrolyte remains unchanged, it can be continuously used and, further, no side reaction takes place. Accordingly, a very high yield of 98 to 100% of a tetraalkylthiuram disulfide can be attained.

In addition, in the process of the present invention, a water layer in which electrolysis is carried out is not discharged outside because of its recycle use, and an extraction solvent containing the desired product can be reutilized for subsequent electrolytic reaction immediately after the desired product is separated and recovered from the solvent by distilling off thereof. Accordingly, the process of the present invention can eliminate the pollution problem of the treatment of waste water due to the by-products contained therein, which is one of the defects encountered in the prior process, and is very suitable as an industrial process for preparing a tetraalkylthiuram disulfide.

In order to indicate more fully the nature and utility of this invention, the following specific examples of practice are set forth, it being understood that these examples are presented as illustrative only and that they are not intended to limit the scope of the invention.

EXAMPLE-A 1

Preparation (1) of a tetramethylthiuram disulfide in water-methylene chloride 20 ml of water is introduced into a 50 ml sidearm flask and 0.8 ml (6 millimoles) of a 50% aqueous solution of dimethylamine and 0.18 ml (3 millimoles) of carbon disulfide are added to the flask, the mixture being stirred to form a homogeneous solution. 160 mg of ammonium chloride as a supporting electrolyte and 3 ml of methylene chloride are added to the solution. This flask is provided with a stirrer, a thermometer and two platinum electrodes (1.5 cm × 2 cm size) at a distance of 3 mm between the anode and the cathode.

Then the reaction temperature is maintained at a temperature of 18° to 20° C., and electrolysis is carried out under the conditions of a terminal voltage of 2V and an electric current density of 2.7 to 0.1 mA/cm$^2$ while the solution was stirred. After a quantity of electricity of $3 \times 10^{-3}$ F is passed, an underlying organic layer is separated from the reaction mixture, and the layer is washed with water, dried, and then distilled under reduced pressure to remove the solvent.

In one instance of practice, 360 mg (yield 100%) of tetramethylthiuram disulfide, which is the desired product, was obtained as white powdery crystals having a melting point of 146.1° C. The results of identification of the crystals by thin-layer chromatography, infrared, and nuclear magnetic resonance absorption spectra and a mixed examination of the crystals with a specimen indicated that they were tetramethylthiuram disulfide.

EXAMPLE-A 2

Preparation (2) of tetramethylthiuram disulfide in water-methylene chloride

According to the procedure described in Example-A 1, an electrolytic reaction was carried out by using carbon electrodes (2 cm × 3 cm size). More specifically, 0.80 ml (6 millimoles) of a 50% aqueous solution of diemthylamine, 0.18 ml (3 millimoles) of carbon disulfide and 160 mg of ammonium chloride as a supporting electrolyte were added to a two layer system comprising 20 ml of water and 3 ml of methylene chloride. The reaction temperature was maintained at 14° to 16° C., and the electrolytic reaction was carried out under the conditions of a terminal voltage of 2V and a current density of 7 to 0.3 mA/cm$^2$ while the solution was stirred. After a quantity of electricity of $3.3 \times 10^{-3}$ F was passed, the same after treatment as that described in Example-A 1 was carried out.

Thus, 356 mg (99% yield) of tetramethylthiuram disulfide was obtained as white powdery crystals having a melting point of 145.7° C. The results of identification of the crystals by thin layer chromatography, infrared and nuclear magnetic resonance absorption spectra, and a mixed examination of the crystals with a specimen indicated that they were tetramethylthiuram disulfide.

EXAMPLE-A 3

Preparation (1) of tetraethylthiuram disulfide in water-carbon disulfide

According to the procedure described in Example-A 1, 0.31 ml (3 millimoles) of diethylamine and 100 mg of tetraethylammonium perchlorate as a supporting electrolyte were added to a two layer system consisting of 20 ml of water and 2 ml of carbon disulfide and platinum electrodes (1.5 cm × 2.0 cm) were immersed in the water layer. The electrolytic reaction was carried out under the conditions of a terminal voltage of 2V and a current density of 15 to 20 mA/cm$^2$. Thus a quantity of electricity of $3 \times 10^{-3}$ F was passed while the solution was stirred at a reaction temperature of 17° to 20° C. Thereafter, an underlying carbon disulfide solution was separated from the reaction mixture and the solution was washed with water, dried and then condensed under reduced pressure.

Thus, tetraethylthiuram disulfide, which was the desired product, was obtained in the form of 438 mg (99% yield) of light greyish white powdery crystals having a melting point of 69.5° to 70° C. The results of identification of the crystals by thin layer chromatography, infrared and nuclear magnetic resonance absorption spectra, and a mixed examination of the crystals with a specimen indicated that they were tetraethylthiuram disulfide.

EXAMPLE-A 4

Preparation (2) of tetraethylthiuram disulfide in water — 1,2-dichloroethane According to the procedure described in Example-A 1, an electrolytic reaction was carried out by using carbon electrodes (2 cm × 3 cm size). More specifically, 0.18 ml (3 millimoles) of carbon disulfide and 100 mg of sodium bromide as a supporting electrolyte were added to 20 ml of water and 0.62 ml (6 millimoles) of diethylamine to prepare a homogeneous solution. Then, 3 ml of 1,2-dichloroethane was added to the solution. The electrolytic reaction was carried out under the conditions of a terminal voltage of 2V amd a current density of 10 to 0.1 mA/cm$^2$ while the solution was stirred at a reaction temperature of 14° to 17° C. After a quantity of electricity of $3.1 \times 10^{-3}$ F was passed, the same after treatment as that described in Example-A 1 was carried out.

Thus, the desired product, tetraethylthiuram disulfide, was obtained in the form of 441 mg (99% yield) of light-greyish white powdery crystals having a melting point of 70.2° C. The results of identification of the crystals by thin layer chromatography, infrared and nuclear magnetic resonance absorption spectra, and a mixed examination of the crystals with a specimen indicated that they were tetraethylthiuram disulfide.

EXAMPLE-A 5

Preparation (1) of tetrabutylthiuram disulfide in water-diethyl ether

According to the procedure described in Example-A 1, the electrolytic reaction was carried out by using platinum electrodes (1.5 cm × 2 cm size). More specifically, 1.02 ml (6 millimoles) of dibutylamine, 0.18 ml (3 millimoles) of carbon disulfide, and 150 mg of ammonium chloride as a supporting electrolyte were added to a mixture of 20 ml of pure water and 5 ml of diethyl ether. The resulting mixture was agitated for about 0.5 hours. The electrolytic reaction was carried out under the conditions of a terminal voltage of 2V and a current density of 5 to 0.1 mA/cm$^2$ with stirring of the solution at a reaction temperature of 16° to 17° C. After a quantity of electricity of $3.3 \times 10^{-3}$F was passed, an organic layer was separated from the reaction mixture, and the layer was washed with a saturated aqueous solution of sodium chloride, dried over anhydrous sodium sulfate, and then distilled under reduced pressure to remoce the solvent.

Thus, the desired product tetrabutylthiuram disulfide was obtained in the form of 599 mg (98% yield) of a dark brown viscous liquid having a solidifying point of 20° C. The results of identification of this product by thin layer chromatography, infrared and nuclear magnetic resonance absorption spectra, and an elemental analysis thereof indicated that it was tetrabutylthiuram disulfide (calculated as $C_{18}H_{36}N_2S_4$: C 52.88%, H 8.89%, N 6.85% analyzed: C 52.84%, H 8.83%, N 6.87%).

EXAMPLE-A 6

Preparation (2) of tetrabutylthiuram disulfide in water — carbon disulfide-methylene chloride According to the procedure described in Example-A 3, the electrolytic reaction was carried out as follows. 0.51 ml (3 millimoles) of dibutylamine and 100 mg of sodium perchlorate as a supporting electrolyte were added to a two layer system comprising 20 ml of pure water, 2 ml of carbon disulfide, and 3 ml of methylene chloride, and the resulting mixture was stirred to produce a homogeneous solution. Platinum electrodes (1.5 cm × 2 cm size) were used. The electrolytic reaction was carried out under the conditions of a terminal voltage of 2V and a current density of 10 to 0.2 mA/cm$^2$ with stirring of the solution at a reaction temperature of 18° to 20° C. After a quantity of electricity of $3.2 \times 10^{-3}$ F was passed, the same after treatment as that described in Example-A 3 was carried out.

Thus, the desired product, tetrabutylthiuram disulfide, was obtained in the form of 495 mg (99% yield) of a dark brown viscous liquid having a solidifying point of 20° C. The results of identification of the product by thin layer chromatography, infrared and nuclear magnetic resonance absorption spectra, and an elemental analysis thereof indicated that it was tetrabutylthiuram disulfide (calculated as $C_{18}H_{36}N_2S_4$: C 52.88%, H 8.89%, N 6.85%; analyzed: C 52.81%, H 8.78%, N 6.89%).

EXAMPLE-B 1

Preparation of tetramethylthiuram disulfide 20 ml of acetonitrile was introduced into a 50 ml side-arm flask and 1.2 ml (9 millimoles) of a 50% aqueous solution of dimethylamine and 0.18 ml (3 millimoles) of carbon disulfide were added to the flask. The resulting mixture was stirred to form a homogeneous solution. 100 mg of tetraethyl ammonium perchlorate as a supporting electrolyte was added to the solution. Then this flask was provided with a stirrer, a thermometer, and two platinum electrodes (1.5 cm × 2 cm size) with a spacing distance of 10 mm therebetween. Then, electrolysis of the solution was carried out under the conditions of a terminal voltage of 2V and a current density of 17 to 10 mA/cm$^2$ with stirring of the solution at a reaction temperature of 12° to 14° C. After a quantity of electricity of $3 \times 10^{-3}$F was passed, the reaction mixture was distilled under reduced pressure to remove the solvent. The residue was dissolved in 5 ml of ether and the solution was washed with water, dried (over $Na_2SO_4$), and condensed.

Thus, the desired product, tetramethylthiuram disulfide, was obtained in the form of 353 mg (98% yield) of white powdery crystals having a melting point of 146.1° C. The results of identification of the crystals by thin layer chromatography, infrared and nuclear magnetic resonance absorption spectra, and a mixed melting point test of the crystals taken together with a specimen indicated that they were tetramethylthiuram disulfide.

EXAMPLE-B 2

Preparation of tetraethylthiuram disulfide

According to the procedure described in Example-B 1, the electrolytic reaction was carried out as follows. 20 ml of N,N-dimethylformamide, 0.62 ml (6 millimoles) of diethylamine, 0.18 ml (3 millimoles) of carbon disulfide, and 100 mg of sodium bromide were added to the flask to form a homogeneous solution. Carbon electrodes (2cm × 3cm size) were used. The electrolytic reaction was carried out under the conditions of a terminal voltage of 2V and a current density of 10 to 0.1 mA/cm$^2$ with stirring of the solution at a reaction temperature of 14° to 17° C. After a quantity of electricity of $3.1 \times 10^{-3}$F was passed, the same after treatment as that described in Example-B 1 was carried out.

Thus, the desired product, tetraethylthiuram disulfide, was obtained in the form of 441 mg (99% yield) of light greyish white powdery crystals having a melting point of 70.2° C. The results of identification of the crystals by thin layer chromatography, infrared and nuclear magnetic resonance absorption spectra, and a mixed examination of the crystals with a specimen indicated that they were tetraethylthiuram disulfide.

EXAMPLE-B 3

Preparation (1) of tetrabutylthiuram disulfide

According to the procedure described in Example-B 1, the electrolytic reaction was carried out as follows. A mixture of 20 ml of N,N-dimethylformamide, 1.02 ml (6 millimoles) of dibutylamine, 0.18 ml (3 milli-moles) of carbon disulfide, and 150 mg of ammonium chloride as a supporting electrolyte was prepared by stirring these ingredients. Platinum electrodes were used. The electrolytic reaction was carried out under the conditions of a terminal voltage of 2V and a current density of 5 to 0.1 mA/cm$^2$ with stirring of the solution at a reaction temperature of 16° to 17° C. After a quantity of electricity of $3.3 \times 10^{-3}$F was passed, the same after treatment as that described in Example-B 1 was carried out.

Thus, the desired product, tetrabutylthiuram disulfide, was obtained in the form of 599 mg (98% yield) of a dark brown viscous liquid having a solidifying point of 20° C. The results of identification of the liquid by thin layer chromatography, infrared and nuclear magnetic resonance spectra, and an elementary analysis thereof indicated that it was tetrabutylthiuram disulfide (calculated as $C_{18}H_{36}N_2S_4$: C 52.88%; H 8.89%, N 6.85%; analyzed: C 52.81%, H 8.83%, N 6.87%).

EXAMPLE-B 4

Preparation (2) of tetrabutylthiuram disulfide in carbon disulfide-acetonitrile According to the procedure described in Example-B 3, the electrolytic reaction was carried out as follows. 0.51 ml (3 millimoles) of dibutylamine and 100 mg of sodium perchlorate as a supporting electrolyte were added to a mixture comprising 20 ml of acetonitrile and 2 ml of carbon disulfide. The resulting mixture was stirred to form a homogeneous solution. Platinum electrodes were used. The electrolytic reaction was carried out under the conditions of a terminal voltage of 2V and a current density of 10 to 0.2 mA/cm$^2$ with stirring of the solution at a reaction temperature of 18 to 20° C. After a quantity of electricity of $3.2 \times 10^{-3}$ F was passed, the same after treatment as that described in Example-B 1 was carried out.

Thus, the desired product, tetrabutylthiuram disulfide, was obtained in the form of 495 mg (99% yield) of a dark brown viscous liquid having a solidifying point of 20° C. The results of identification of the liquid by thin layer chromatography, infrared and nuclear magnetic resonance absorption spectra, and an elementary analysis thereof indicated that it was tetrabutylthiuram disulfide (calculated as $C_{18}H_{36}N_2S_4$: C 52.88%, H 8.89%, N 6.85%; analyzed: C 52.8%, H 8.78%, N 6.89%).

As can be seen from the above described examples, it is clear that the process for preparing a tetrabutylthiuram disulfide according to the present invention is simple in reaction process and is not accompanied by any side reactions, thereby providing a tetraalkylthiuram disulfide of good quality in a high yield because a dialkylamine and carbon disulfide are directly coupled by electrolytic oxidation.

We claim

1. A process for producing a tetraalkylthiuram disulfide which comprises electrolytically oxidizing a dialkylammonium dialkyldithiocarbamate having the formula

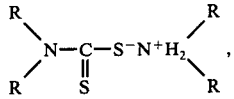

wherein each R represents an alkyl group having from 1 to 4 carbon atoms, in the presence or absence of a supporting electrolyte to produce a tetraalkylthiuram disulfide, said electrolytic oxidation being carried out in at least one solvent which dissolves at least one of the starting dialkylammonium dialkyldithiocarbamate and the resulting tetraalkylthiuram disulfide.

2. A process as claimed in claim 1, wherein the solvent is a two layer system comprising water and a hydrophobic solvent, and the resultant dialkylthiuram disulfide is continuously and automatically extracted into the hydrophobic solvent.

3. A process as claimed in claim 1, wherein the solvent consists of at least one organic solvent.

4. A process as claimed in claim 1, wherein the solvent is a mixture of a water-soluble organic solvent and water.

5. A process as claimed in claim 1, wherein the starting dialkylammonium dialkyldithiocarbamate is obtained by mixing the corresponding secondary amine and carbon disulfide in the presence of at least part of the solvent to be used in the electrolytic oxidation.

6. A process as claimed in claim 1, wherein the starting dialkylammonium dialkyldithiocarbamate is produced in the electrolytic solution during the electrolytic oxidation by adding the corresponding secondary amine and carbon disulfide to the electrolytic solution.

7. A process as claimed in claim 6, wherein the solvent is a two layer system comprising water and carbon disulfide which is a hydrophobic solvent.

8. A process as claimed in claim 1, wherein in the case of electrolysis in a two layer system, the electrolytic solution contains a small quantity of an alkali metal hydroxide.

* * * * *